US010051953B2

(12) United States Patent
Hobbs

(10) Patent No.: US 10,051,953 B2
(45) Date of Patent: Aug. 21, 2018

(54) METHOD OF FORMING A BRISTLE STACK FOR PAINT BRUSHES

(71) Applicant: LG Harris & Co Limited, Bromsgrove Worcestershire (GB)

(72) Inventor: Stuart Hobbs, Norton Shropshire (GB)

(73) Assignee: LG HARRIS & CO LIMITED, Bromsgrove Worcestershire (GB)

( * ) Notice: Subject to any disclaimer, the term of this patent is extended or adjusted under 35 U.S.C. 154(b) by 132 days.

(21) Appl. No.: 14/885,293

(22) Filed: Oct. 16, 2015

(65) Prior Publication Data

US 2016/0135583 A1 May 19, 2016

(51) Int. Cl.

| | |
|---|---|
| ***A46B 3/12*** | (2006.01) |
| ***A46B 9/02*** | (2006.01) |
| ***A46D 1/04*** | (2006.01) |
| ***A46D 3/00*** | (2006.01) |
| ***A46D 3/04*** | (2006.01) |

(52) U.S. Cl.

CPC ..... *A46D 3/047* (2013.01); *A46B 3/12* (2013.01); *A46B 9/026* (2013.01); *A46B 9/028* (2013.01); *A46D 1/04* (2013.01); *A46B 2200/202* (2013.01); *Y10S 15/05* (2013.01)

(58) Field of Classification Search

CPC .... A46B 3/08; A46B 3/10; A46B 3/12; A46B 9/00; A46B 9/02; A46B 9/026; A46B 9/028; A46B 2200/20; A46B 9/202; A46B 9/205; A46D 1/00; A46D 1/04; A46D 1/06; A46D 3/00; A46D 3/047; A46D 9/00; A46D 9/02; Y10S 15/04; Y10S 15/05

USPC ..... 15/159.1, 160, 191.1, 192, 193, 204, 15/DIG. 4, DIG. 5; 300/2, 8, 17, 19, 21; D4/135

See application file for complete search history.

(56) References Cited

U.S. PATENT DOCUMENTS

| | | | | | |
|---|---|---|---|---|---|
| 2,202,292 | A | * | 5/1940 | Howard | A46B 5/02 15/143.1 |
| 2,258,361 | A | * | 10/1941 | Hewes | A46B 3/12 15/192 |
| 2,652,580 | A | * | 9/1953 | Neugass | A46B 3/06 15/145 |
| D380,615 | S | * | 7/1997 | Roberts | D4/135 |
| D584,897 | S | * | 1/2009 | Belley | D4/135 |

(Continued)

FOREIGN PATENT DOCUMENTS

| | | | |
|---|---|---|---|
| DE | 378689 | * | 7/1923 |
| DE | 1457022 | * | 12/1968 |

(Continued)

OTHER PUBLICATIONS

International Search Report issued in Appln. No. GB1420012.5.

(Continued)

*Primary Examiner* — Mark Spisich

(74) *Attorney, Agent, or Firm* — McAndrews, Held & Malloy, Ltd.

(57) ABSTRACT

A paint brush is provided and comprises a handle, a ferrule and a bristle stack. The bristle stack comprises a plurality of synthetic, virgin bristle filaments secured at one end in the ferrule. At the opposite end of the bristle stack the ends of the filaments collectively define a first notional plane which is generally curved, and a second notional plane which is generally orthogonal to the first notional plane and is also generally curved.

10 Claims, 10 Drawing Sheets

(56) References Cited

U.S. PATENT DOCUMENTS

| | | | | | |
|---|---|---|---|---|---|
| D591,515 | S | * | 5/2009 | Belley | D4/135 |
| D632,488 | S | | 2/2011 | Twigg | |
| 2014/0259489 | A1 | | 9/2014 | Dale | |

FOREIGN PATENT DOCUMENTS

| | | | | |
|---|---|---|---|---|
| DE | 3024382 | A1 | | 1/1982 |
| EP | 2377424 | | * | 10/2011 |
| EP | 2377425 | | * | 10/2011 |
| GB | 806597 | | * | 12/1958 |
| GB | 2328148 | A | | 2/1999 |
| JP | 2008-295706 | | * | 12/2008 |
| WO | 93/21795 | | | 11/1993 |
| WO | 2008077466 | A1 | | 7/2008 |

OTHER PUBLICATIONS

European Patent Office, "Extended European Search Report," issued in connection with Application No. 15190083.4, dated Mar. 30, 2016, 8 pages.

UK Intellectual Property Office, "Search Report," issued in connection with Application No. GB1518291.8, dated Apr. 15, 2016, 3 pages.

GB Intellectual Property Office, "Examination Report," dated Jan. 25, 2017 in Application No. GB1518291.8, 3 pages.

* cited by examiner

METHOD OF FORMING A BRISTLE STACK FOR PAINT BRUSHES

RELATED APPLICATIONS

This application claims priority to Great Britain Application No. 1420012.5 having a filing date of Nov. 11, 2014, and Great Britain Application No. 1423139.3 having a filing date of Dec. 23, 2014. The entire text of the aforementioned applications is incorporated herein by reference in its entirety.

BACKGROUND OF THE INVENTION

The present invention relates generally to a paint brush and to improvements in or relating to the painting experience and the quality of the finish achievable with a paint brush.

The present invention seeks to provide improvements in or relating to paint brushes.

An aspect of the present invention provides a paint brush comprising a handle, a ferrule and a bristle stack, the bristle stack comprising a plurality of synthetic, virgin bristle filaments, the bristle stack being secured at one end in the ferrule, in which at the opposite end of the bristle stack the ends of the filaments collectively define a first notional plane which is generally curved, and a second notional plane which is generally orthogonal to the first notional plane and is also generally curved.

A further aspect provides a paint brush comprising a handle, a ferrule and a bristle stack, the bristle stack comprising a plurality of bristle filaments, the bristle stack being secured at one end in the ferrule, in which at the opposite end of the bristle stack the ends of the filaments define a first notional plane which is curved, and a second notional plane which is generally orthogonal to the first notional plane and is also curved.

The end of the bristle stack in the ferrule may be generally the same shape as the opposite end. In some embodiments the shaping of the filaments may be achieved by a "push-up" process in which a tool is used at the ferrule end of the stack to push the filaments up to conform to the shape of the tool. In these embodiments the length of all of the bristles in the stack may be substantially the same. In other embodiments the shaping may be achieved, for example, by a trimming process.

The bristle stack may be a generally quadrilateral shape, for example generally oblong or generally square. The stack shape may have one or more radii in plan.

At least some of the bristle filaments may be formed from a natural material. Alternatively or additionally at least some of the bristle filaments may be formed from a synthetic material.

The curvature of the first and second notional planes may be the same, similar or different.

In a further aspect there is provided a paint brush comprising a handle, a ferrule and a bristle stack, the bristle stack comprising a plurality of bristle filaments, the bristle stack being secured at one end in the ferrule, in which at the opposite end of the bristle stack the profile defined by the ends of the filaments is curved in two directions relative to a notional terminal plane, the first and second directions being generally orthogonal to each other.

A further aspect provides a paint brush comprising a handle, a ferrule and a bristle cluster, the bristle cluster comprising a plurality of virgin bristle filaments, the bristle cluster being secured at one end in the ferrule, in which at the opposite end of the bristle stack the ends of the virgin filaments define a first notional plane which is curved, and a second notional plane which is generally orthogonal to the first notional plane and is also curved.

A further aspect provides a paint brush comprising a handle, a ferrule and a bristle stack, the bristle stack comprising a plurality of virgin bristle filaments, the bristle stack being secured at one end in the ferrule, in which at the opposite end of the bristle stack the ends of the virgin filaments collectively define a terminus which is curved in an x-axis direction and also curved in a y-axis direction.

For example, in an oblong bristle stack the x-axis direction may be the long axis of the oblong.

A further aspect provides a paint brush comprising a handle, a ferrule and a filament block stack, the block comprising a plurality of virgin bristle filaments, the block being secured at one end in the ferrule, in which at the opposite end of the bristle stack the ends of the virgin filaments together define a terminus which is curved in front elevation and also curved in side elevation.

A further aspect provides a paint brush comprising a handle, a ferrule and a bristle stack, the bristle stack comprising a plurality of bristle filaments and being secured at one end in the ferrule, in which at the opposite end of the bristle stack the ends of the filaments define a pre-shaped, double-domed terminus.

A further aspect provides a paint brush comprising a handle, a ferrule and a bristle stack, the bristle stack comprising a plurality of virgin bristle filaments, the bristle stack being secured at one end in the ferrule, in which at the opposite end of the bristle stack the ends of the virgin filaments collectively define a terminus which is curved longitudinally and curved latitudinally.

A further aspect provides a paint brush bristle cluster comprising a plurality of filaments which collectively provide a tip profile with bi-planar curvature.

A further aspect provides a paint brush bristle cluster comprising a plurality of filaments the tips of which collectively define a virtual plane with bi-planar curvature.

A further aspect provides a method of forming a bristle stack for a paint brush comprising the steps of:

- providing a plurality of bristle filaments
- forming the filaments into a stack
- shaping one end of the bristle stack such that the ends of the filaments collectively define a terminus which is curved in an x-axis direction and also curved in a y-axis direction.

The shaping may, for example, be achieved by a push-up process in which the opposite end of the bristle stack is pressed onto a forming tool. Alternatively or additionally the shaping may be achieved by trimming the terminus.

In some embodiments the bristle stack shaping may be performed manually. Alternatively or additionally the bristle stack shaping may be automated.

A further aspect provides a method of forming a paint brush comprising the steps of:

- providing a plurality of bristle filaments
- forming the filaments into a stack
- placing the stack into a ferrule
- shaping one end of the bristle stack such that the ends of the filaments collectively define a terminus which is curved in an x-axis direction and also curved in a y-axis direction
- securing the ferrule to a handle.

The stack shaping is achieved by a push-up process in which the opposite end of the bristle stack is pressed onto a forming tool. Alternatively or additionally the stack shaping may be achieved by trimming the terminus.

Also provided is a bristle stack as shown and described herein.

Also provided is a paint brush as shown and described herein.

Also provided is a method of forming a bristle stack as shown and described herein.

Also provided is a method of forming a paint brush as shown and described herein.

Paint brushes formed in accordance with the present invention may be produced in a variety of sizes.

Paint brushes may be packed individually or together with other paint brushes (which may or may not have the double dome terminus).

Different aspects and embodiments of the invention may be used separately or together.

Further particular and preferred aspects of the present invention are set out in the accompanying independent and dependent claims. Features of the dependent claims may be combined with the features of the independent claims as appropriate, and in combination other than those explicitly set out in the claims.

BRIEF DESCRIPTION OF SEVERAL VIEWS OF THE DRAWINGS

The present invention will now be more particularly described, by way of example, with reference to the above accompanying drawings, in which.

Figure 1:
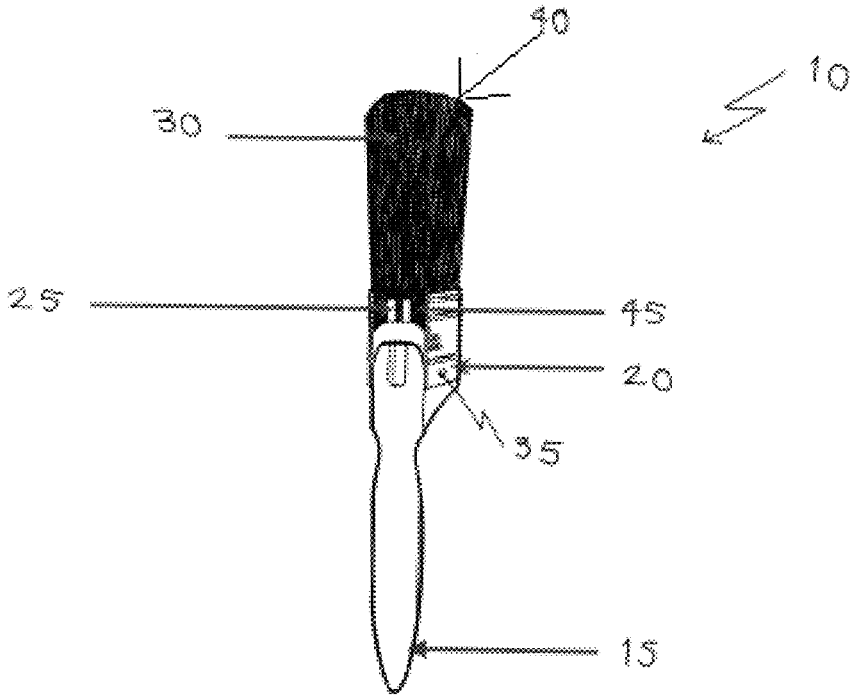
FIG. 1 is a perspective sectional view of a paint brush formed according to the present invention.

Example embodiments are described below in sufficient detail to enable those of ordinary skill in the art to embody and implement the systems and processes herein described. It is important to understand that embodiments can be provided in many alternate forms and should not be construed as limited to the examples set forth herein.

Accordingly, while embodiments can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate.

The terminology used herein to describe embodiments is not intended to limit the scope. The articles "a," "an," and "the" are singular in that they have a single referent, however the use of the singular form in the present document should not preclude the presence of more than one referent. In other words, elements referred to in the singular can number one or more, unless the context clearly indicates otherwise. It will be further understood that the terms "comprises," "comprising," "includes," and/or "including," when used herein, specify the presence of stated features, items, steps, operations, elements, and/or components, but do not preclude the presence or addition of one or more other features, items, steps, operations, elements, components, and/or groups thereof.

In the following description, all orientational terms, such as upper, lower, radially and axially, are used in relation to the drawings and should not be interpreted as limiting on the invention.

Unless otherwise defined, all terms (including technical and scientific terms) used herein are to be interpreted as is customary in the art. It will be further understood that terms in common usage should also be interpreted as is customary in the relevant art and not in an idealized or overly formal sense unless expressly so defined herein.

Referring first to FIG. 1 there is shown a paint brush generally indicated 10. Only half of the brush is shown so that the structure can be described.

The brush 10 comprises: a handle 15; a ferrule 20 which includes a plurality of plugs 25; and a brush head 30.

The handle 15 can be made in a variety of shapes and sizes and from different materials (such as wood or plastics).

The ferrule 20 may be formed from metal, such as stainless steel, stainless iron or nickel-plated steel. The ferrule holds the brush head and the handle together, secured by pins 35.

The brush head 30 is made from a plurality of bristle filaments 40. The filaments may be synthetic and/or natural.

The filament roots and the plugs are fixed into the ferrule by an epoxy adhesive 45.

Figure 2:
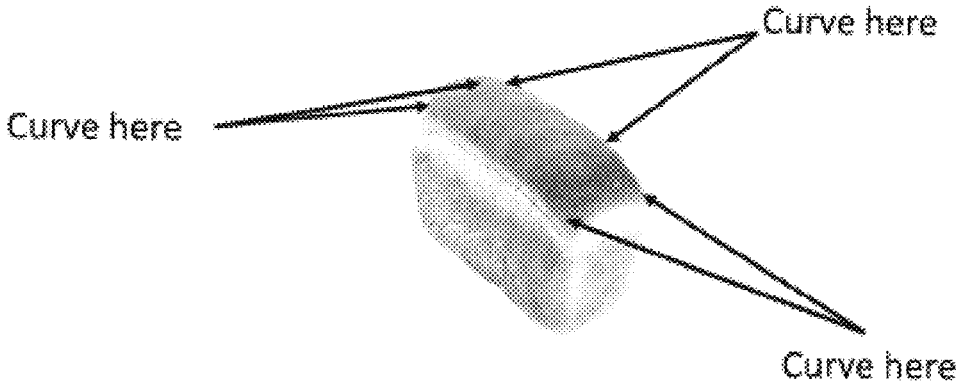
FIGS. 2 and 3 are schematic representations explaining the shape corresponding to a bristle termini formed in accordance with the present invention.
Figure 3:
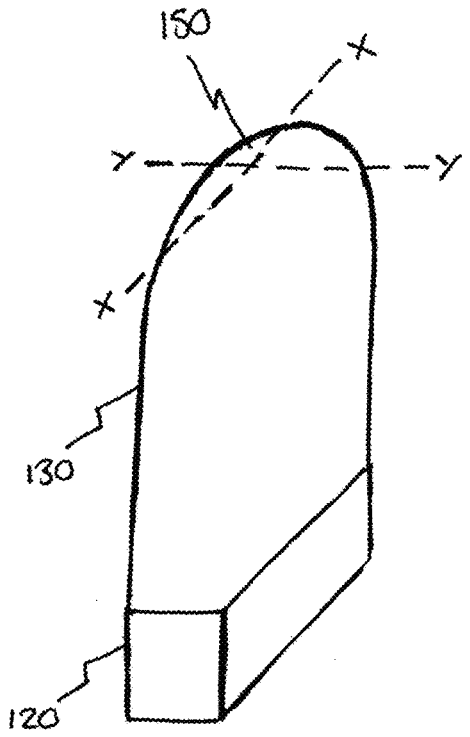

Referring now to FIGS. 2 and 3, the shape of the end of a bristle stack may be reminiscent of the top of a loaf of bread i.e. curved in two directions. For example, in a bristle stack 130 which is generally oblong in plan the shape 150 defined collectively by the bristle tips is curved along the x-axis and also along the y-axis with respect to a notional generally flat terminal painting plane to give a "double dome" terminus.

Figure 4:
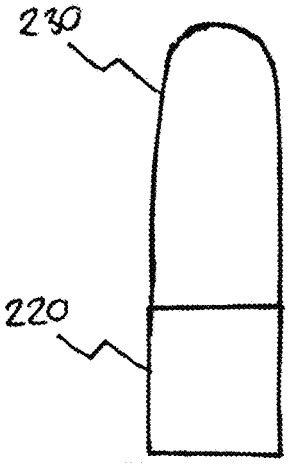
FIGS. 4 and 5 are side and front elevations of a brush head formed according to an embodiment of the present invention.
Figure 5:
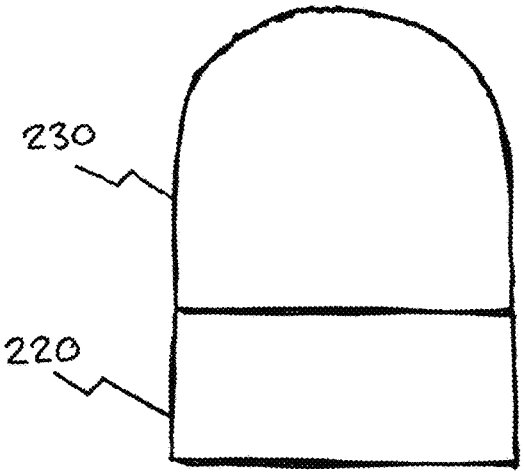

In FIGS. 4 and 5 side and front elevations of a bristle stack 230 illustrate the double direction curvature.

Figure 8:
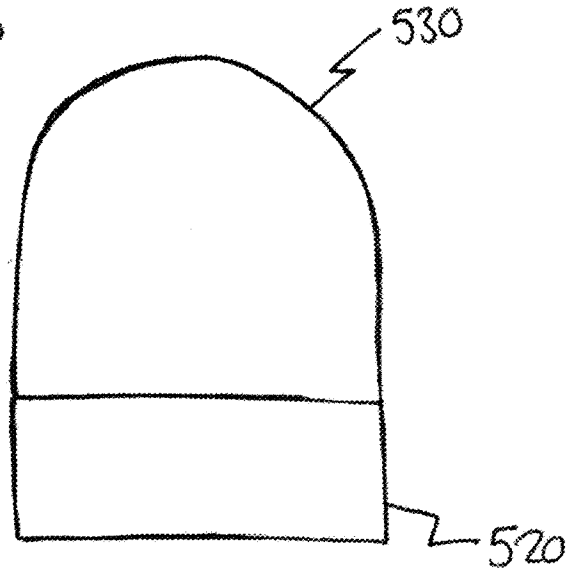
FIGS. 6, 7 and 8 show three alternative bristle stack shapes.
Figure 7:
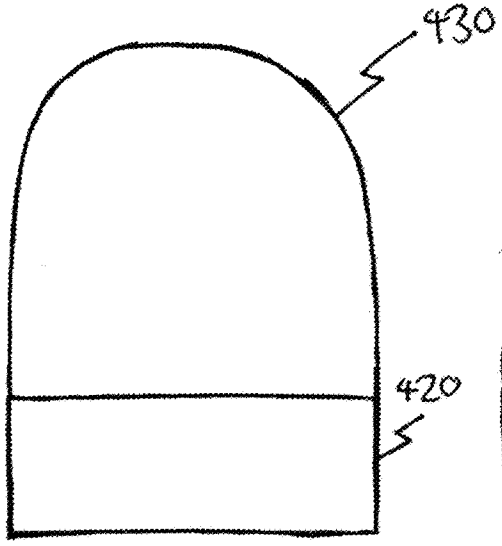
Figure 6:
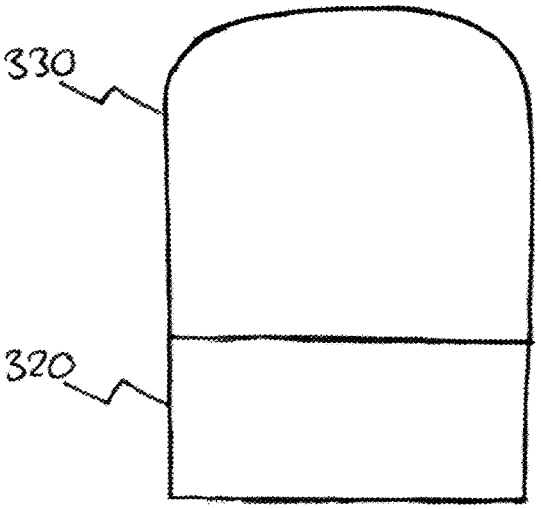
Figure 9:
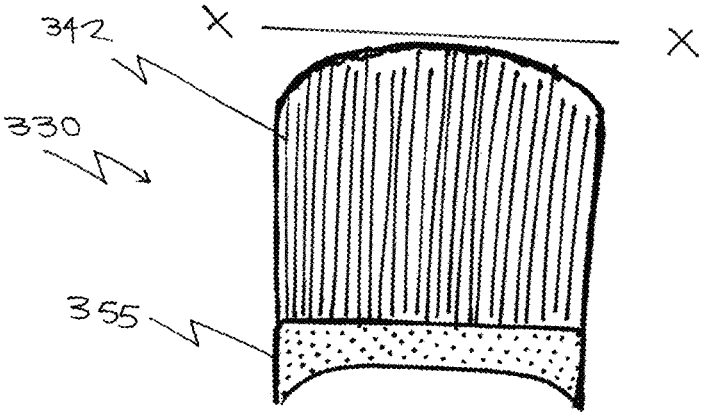
FIGS. 9, 10 and 11 show front elevations of a brush head formed according to a further embodiment of the present invention.
Figure 10:
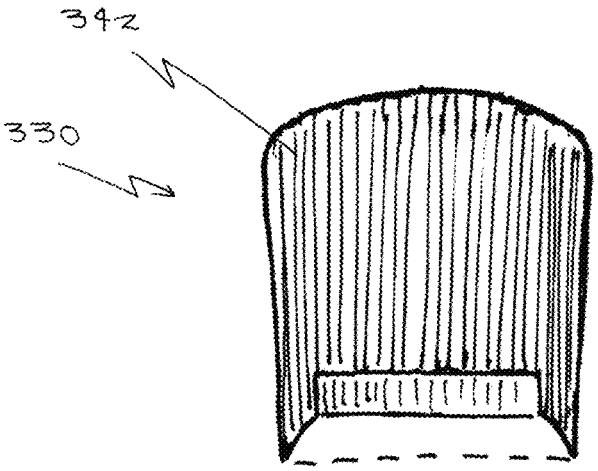
Figure 11:
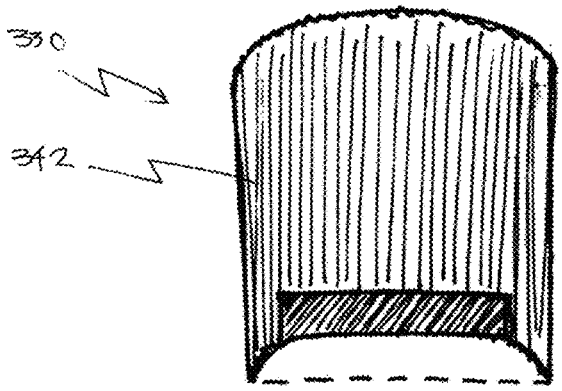
Figure 12:
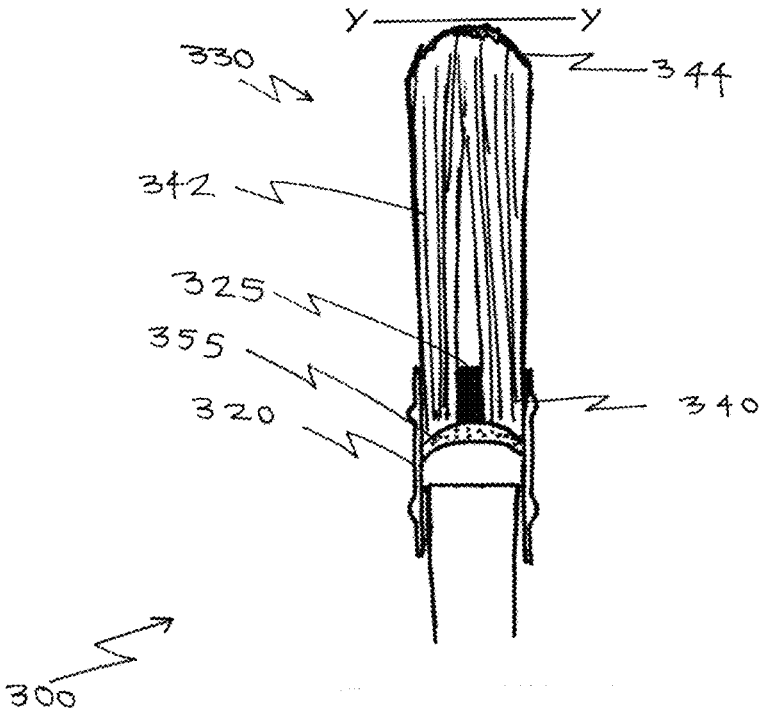
FIG. 12 is a side elevation of the brush head of FIGS. 9 to 11.

In FIGS. 6 to 8 three alternative brush head designs illustrate different degrees of generally even curvature across bristle stacks: FIG. 6=slight dome; FIG. 7=medium dome; FIG. 8=extreme dome.

FIGS. 9 to 12 show the front and side elevations of a bristle stack 330 of a brush 300 (FIG. 12) according to an embodiment of the invention. The front face of the bristle stack 330 is substantially oblong in shape. The bristle stack 330 comprises a plurality of bristle filaments 342 with a first end 340 to be secured in the ferrule 320. The stack end 340 is fitted with a plurality of spacer plugs 325 and is set in a resin block 355.

The filaments 342 are all approximately the same length and at the ends 340 they terminate so as collectively to define a double domed recess. The opposite end 344 of the bristle stack 330 therefore collectively define a profile which is curved in two directions (x-x and y-y) relative to a notional terminal plane, the first (x-x) and second (y-y) directions being generally orthogonal to each other. The end 344 of the stack therefore defines a double domed terminus. The terminus is curved in a longitudinal direction as well as in a latitudinal direction. It can be seen that the terminus 344 has a slight dome shape along the x-x direction. From FIG. 12 it can be seen that the terminus has a greater dome shape along the y-y direction.

The shape and dimensions of the stack 330 are selected to provide a brush 300 having a double domed terminus having predetermined curvatures in both longitudinal and lateral directions as determined by the particular requirements for the brush 300.

Figure 13:
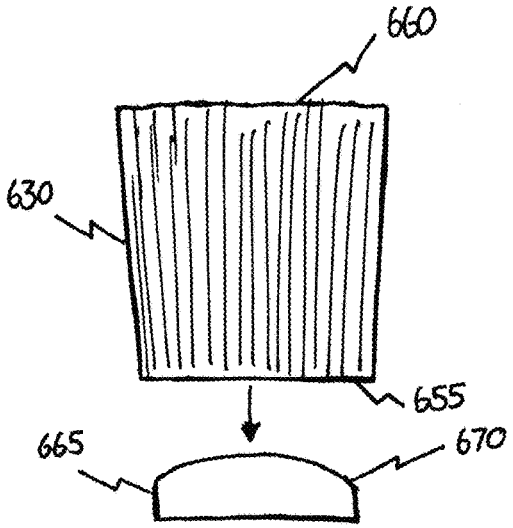
FIGS. 13 and 14A and 14B illustrate one method of forming a bristle stack in accordance with the present invention.

In FIG. 13 an unshaped bristle stack 630 is shown. In this embodiment, all of the bristle filaments in the stack are virgin (i.e. unused) filaments formed from a synthetic material (such as Nylon®, PET or PBT). All of the filaments are generally the same length and are generally aligned at the ferrule end 655 and the terminal end 660 of the stack.

According to a method of the present invention a tool 665 is provided. The tool includes an upper surface 670 which is curved in two directions.

As illustrated in FIG. 13 the stack 630 is lowered onto the tool (in other embodiments the stack may be stationary and the tool may move towards it; in other embodiments both the tool and the stack may move).

Figure 14A:
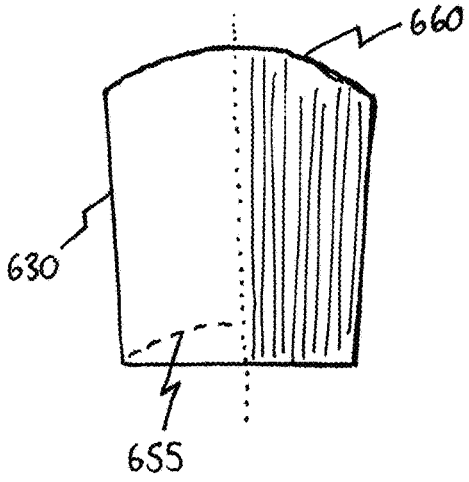
Figure 14B:
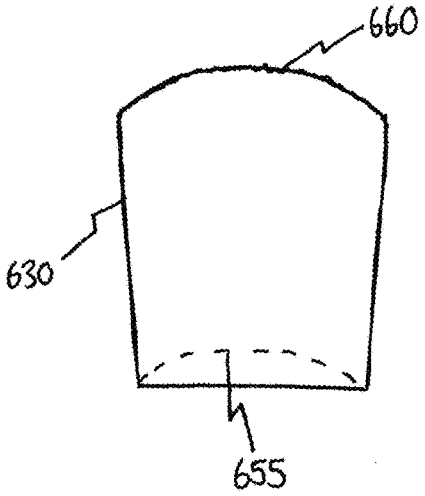

In a "push-up" process the tool causes the ferrule end 655 of the stack 630 to conform to its shape and a corresponding shape is formed at the terminal end 660. The cluster is therefore pushed up domed. The resulting shaped bristle cluster 630 is shown in FIGS. 14A and 14B and has a tip profile which falls away at all four corners to give a "pre-worn" shape.

The stack 630 may be presented to the tool 665 with the filaments already fitted into a ferrule (not shown).

In this embodiment the shaping is achieved with a manual push-up process, with a stationary tool and the stack being pressed down onto it from above.

Figure 15:
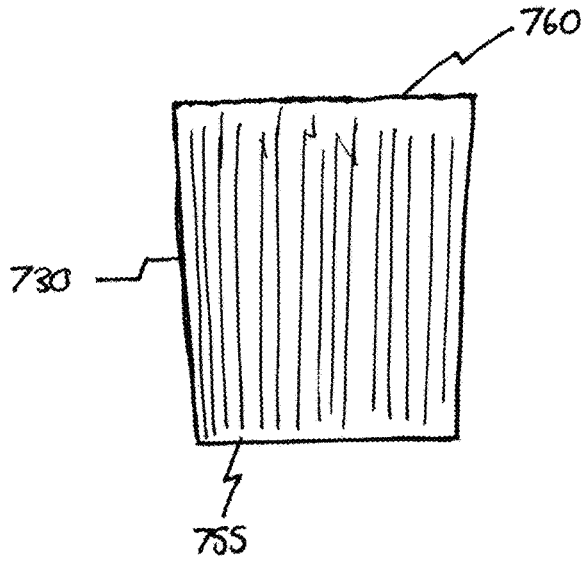
FIGS. 15 and 16 illustrate an alternative method.
Figure 16:
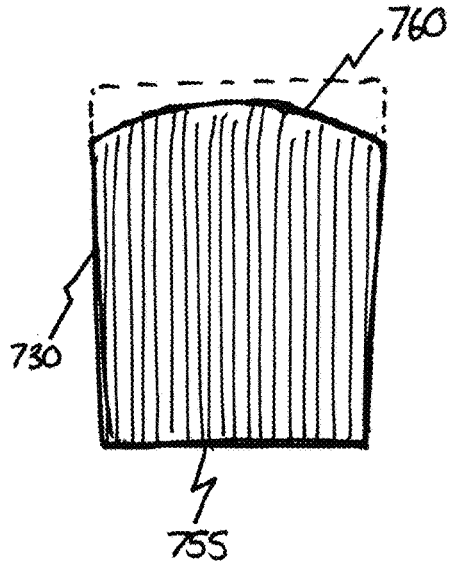
Figure 17:
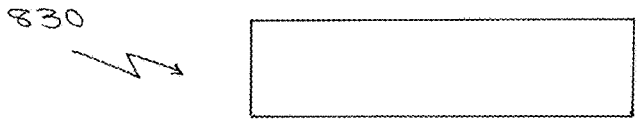
FIGS. 17, 18, 19, 20, 21, and 22 show various different examples of bristle stack shapes when viewed in plan.
Figure 18:
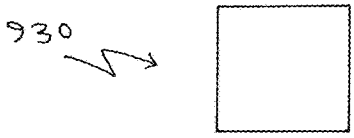
Figure 19:
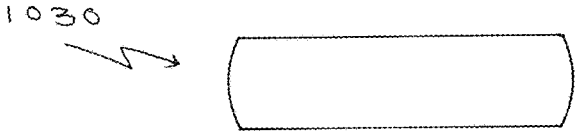
Figure 20:
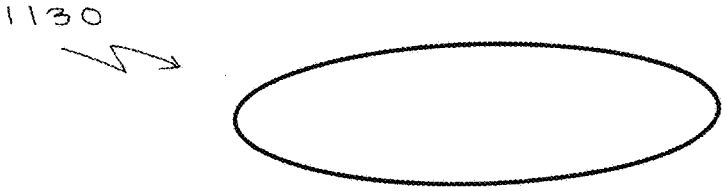
Figure 21:
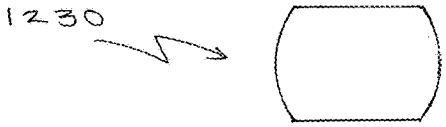
Figure 22:
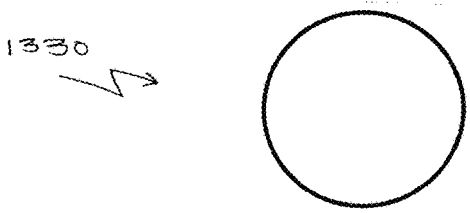
Figure 24:
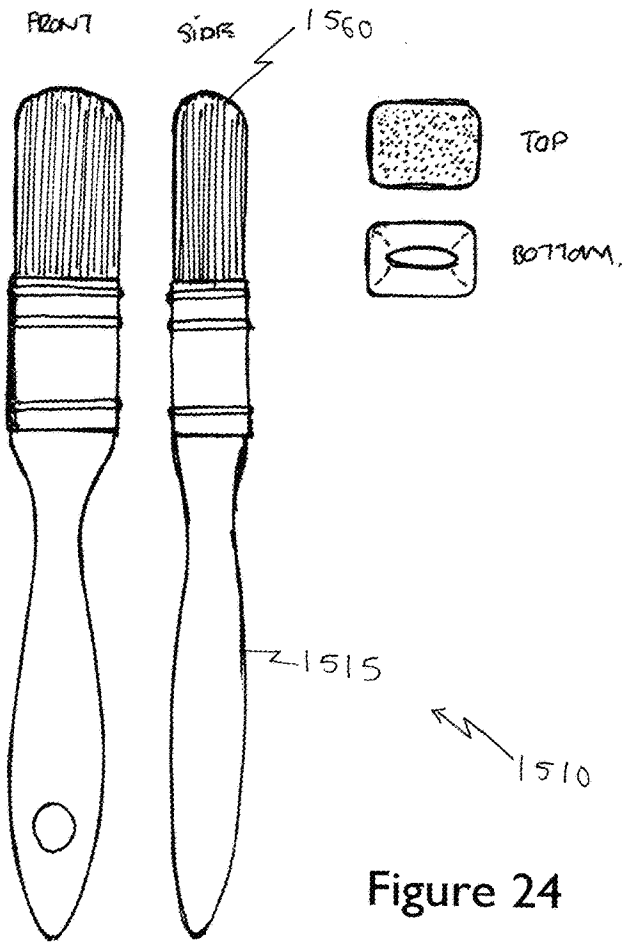
FIGS. 23, 24, 25, and 26 show front, side, top and bottom views of paint brushes formed according to different embodiments of the present invention.
Figure 23:
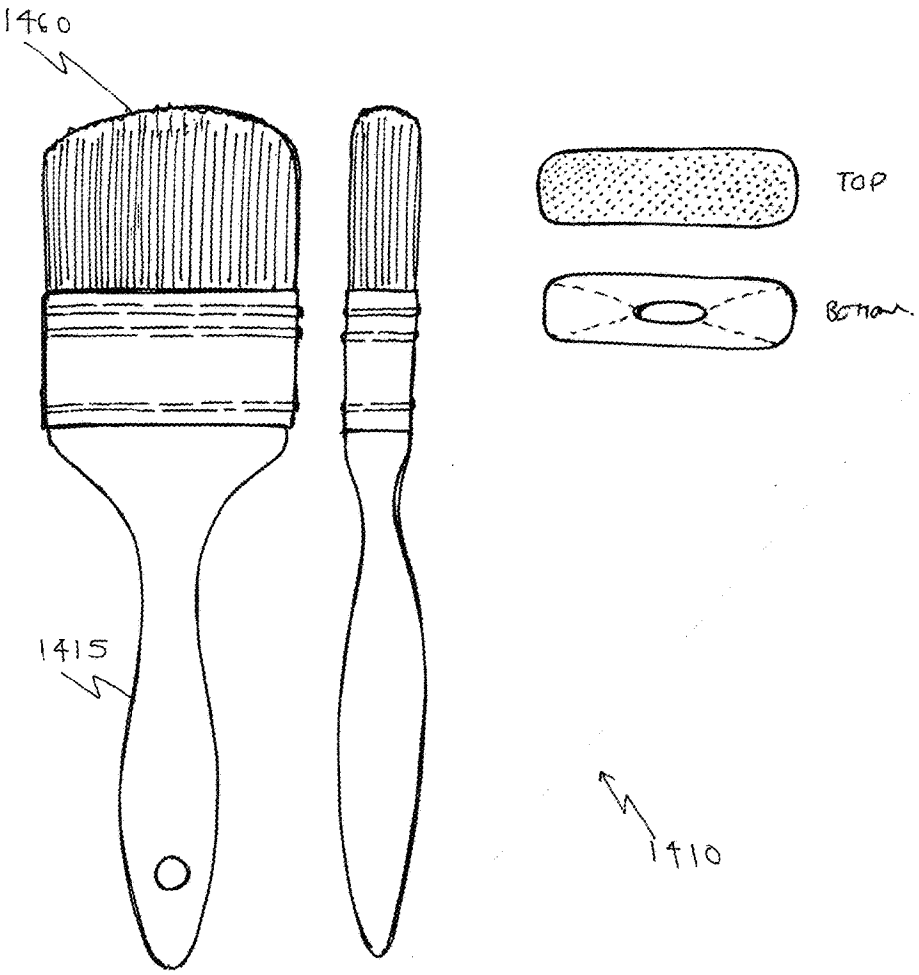
Figure 26:
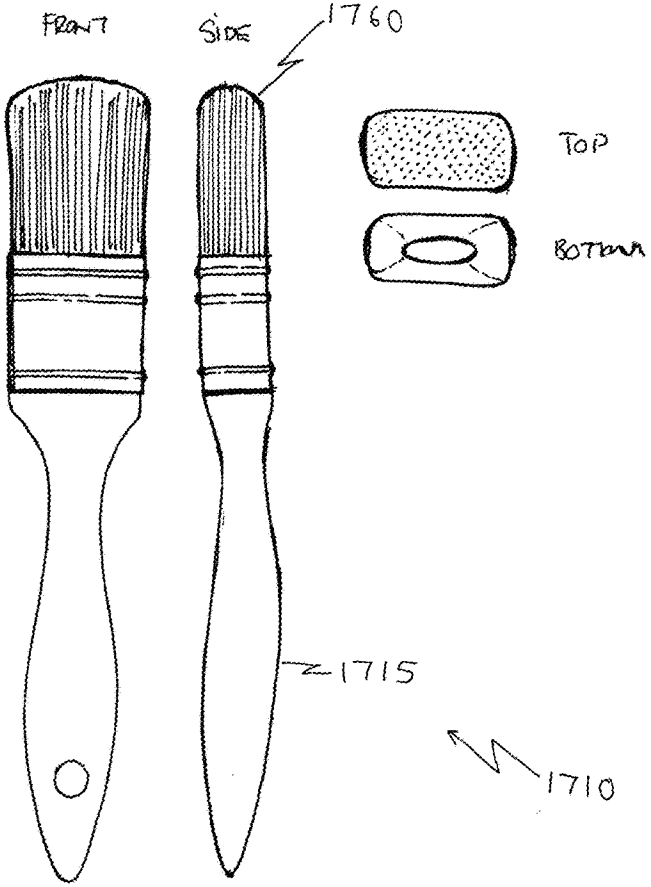
Figure 25:
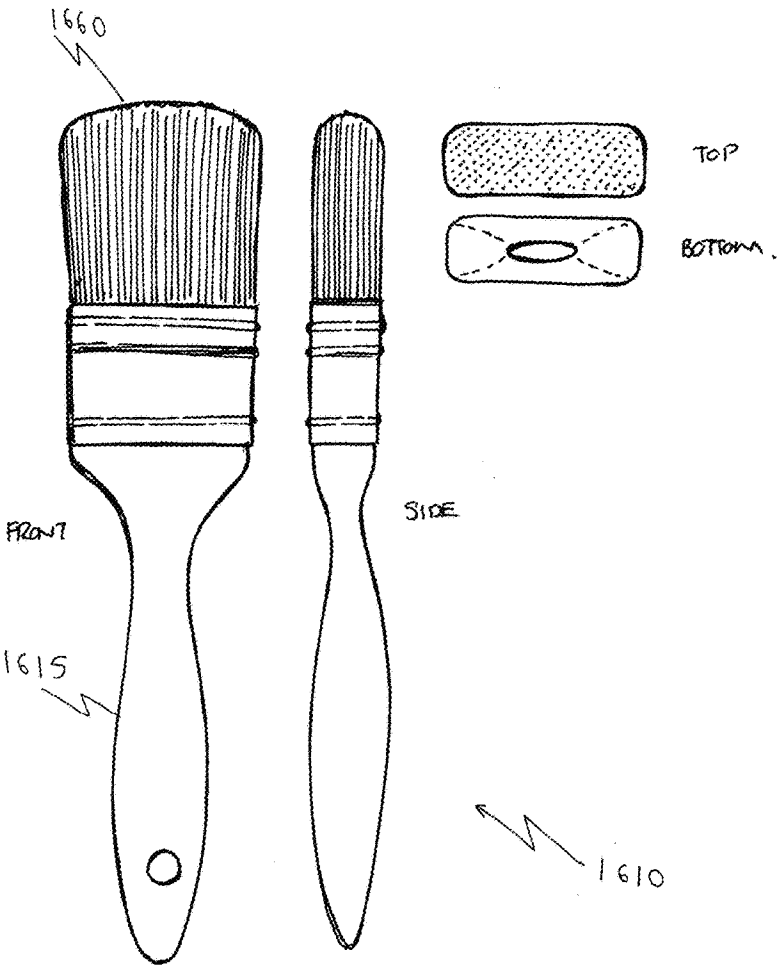

In FIGS. 15 and 16 an alternative shaping process is shown.

In FIG. 15 a filament cluster 730 is shown. In this embodiment, all of the bristle filaments in the cluster are generally the same length and are generally aligned at the ferrule end 755 and the terminal end 760 of the cluster. The cluster may still be pushed up as part of the manufacturing process, but it is pushed up "flat".

To shape the terminal end 760 to achieve a double dome tip profile an automated trimming process is used (FIG. 16). This means that at the end 755 the plane defined by the filament roots remains flat.

In FIGS. 17 to 22 plan views of multi-domed bristle clusters formed in accordance with the present invention are shown: oblong 830; square 930; oblong with curved ends 1030; ellipsoidal 1130; square with curved sides 1230; and circular 1330.

In FIGS. 23 to 26 brushes 1410, 1510, 1610, 1710 formed according to further embodiments and including bristle clusters having double domed tip profiles 1460, 1560, 1660, 1760 with bi-planar curvature are shown.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention as defined by the appended claims and their equivalents.

The invention claimed is:

1. A method of forming a bristle stack for a paint brush comprising the steps of:

providing a plurality of bristle filaments, all of the bristle filaments being generally the same length forming the filaments into a bristle stack, said bristle stack being generally quadrilateral shape in plan and said bristle stack having a ferrule end and an opposite end;

placing said bristle stack into a ferrule;

presenting said bristle stack to a forming tool with the bristle filaments already fitted into the ferrule;

providing the forming tool having an upper surface with a predetermined shape which is curved in two directions; and using a push-up process such that the ferrule end of the bristle stack is caused to conform to the shape of the forming tool, in doing so shaping the bristle stack such that both ends of the bristle stack collectively define a first notional plane which is generally curved, and a second notional plane which is generally orthogonal to the first notional plane and is also generally curved, said first notional plane being curved in an x-axis direction of said generally quadrilateral shape and said second notional plane being curved in a y-axis direction of said generally quadrilateral shape.

2. The method of claim 1, in which the bristle stack shaping is performed manually.

3. The method of claim 1, in which the bristle stack shaping is automated.

4. The method of claim 1, wherein said bristle filaments are synthetic, virgin bristle filaments.

5. The method of claim 1, wherein the ferrule end of the bristle stack is set into a resin block after the shaping has taken place.

6. The method of claim 5, wherein a plurality of plugs are provided in the resin block.

7. The method of claim 1, wherein the ferrule end of the bristle stack is pressed onto the forming tool in a push-up process.

8. The method of claim 1, wherein the bristle stack is generally oblong in plan.

9. The method of claim 1, further including a step of securing a handle to the bristle stack to form a paint brush.

10. A method of forming a bristle stack for a paint brush comprising the steps of:

providing a plurality of bristle filaments, all of the bristle filaments being generally the same length;

forming the bristle filaments into a bristle stack said bristle stack being generally ellipsoidal shape in plan and said bristle stack having a ferrule end and an opposite end; and placing the bristle stack into a ferrule end;

presenting the bristle stack to a forming tool with the bristle filaments already fitted into the ferrule;

providing the forming tool having an upper surface with a predetermined shape which is curved in two directions; and using a push-up process to cause a ferrule end of the bristle stack to conform to the shape of the forming tool thereby shaping the bristle stack such that both ends collectively define a first notional plane which is generally curved, and a second notional plane which is generally orthogonal to the first notional plane and is also generally curved, said first notional plane being curved in an x-axis direction of said generally ellipsoidal shape and said second notional plane being curved in a y-axis direction of said generally ellipsoidal shape.

* * * * *